US012680179B2

(12) United States Patent
Richet et al.

(10) Patent No.: US 12,680,179 B2
(45) Date of Patent: Jul. 14, 2026

(54) ELECTROLYSIS STACK

(71) Applicant: L'Air Liquide, Société Anonyme pour l'Etude et l'Exploitation des Procédés Georges Claude, Paris (FR)

(72) Inventors: Nicolas Richet, Fontenay-le-Fleury (FR); Olivier Debellemaniere, Bures-sur-Yvette (FR); Guillaume Lodier, Senlisse (FR); Anh Thao Thieu, Saint Cloud (FR); Hakim Maazaoui, Longjumeau (FR); Florent Beille, Lans-en-Vercors (FR)

(73) Assignee: L'Air Liquide, Societe Anonyme Pour l'Etude et l'Exploitation des Procedes Georges Claude, Paris (FR)

( * ) Notice: Subject to any disclaimer, the term of this patent is extended or adjusted under 35 U.S.C. 154(b) by 818 days.

(21) Appl. No.: 17/984,504

(22) Filed: Nov. 10, 2022

(65) Prior Publication Data

US 2023/0143573 A1 May 11, 2023

(30) Foreign Application Priority Data

Nov. 11, 2021 (EP) ..... 21207818

(51) Int. Cl.
*C25B 9/23* (2021.01)
*C25B 1/04* (2021.01)
(Continued)

(52) U.S. Cl.
CPC ..... *C25B 9/23* (2021.01); *C25B 1/04* (2013.01); *C25B 11/032* (2021.01); *C25B 15/08* (2013.01)

(58) Field of Classification Search
CPC ..... C25B 1/04
See application file for complete search history.

(56) References Cited

U.S. PATENT DOCUMENTS

| | | | | |
|---|---|---|---|---|
| 4,358,357 | A | 11/1982 | Pere | |
| 2006/0254907 | A1 | 11/2006 | Taruya et al. | |
| 2020/0124039 | A1 * | 4/2020 | Ukai | C25B 1/04 |

FOREIGN PATENT DOCUMENTS

| | | | |
|---|---|---|---|
| JP | H08 239788 | 9/1996 | |
| JP | 2004 115860 | 4/2004 | |
| WO | WO-2020260370 A1 * | 12/2020 | C25B 15/08 |

OTHER PUBLICATIONS

Brinner et al., Original & Machine Translation, EP 3696298 A1 (Year: 2020).*

(Continued)

*Primary Examiner* — Hosung Chung
(74) *Attorney, Agent, or Firm* — Elwood L. Haynes

(57) ABSTRACT

Electrolysis stack, including multiple layers that are stacked along a stacking direction, wherein each of the layers includes an anode space with an anode, a cathode space with a cathode and a membrane that separates the anode space and the cathode space from each other, wherein the anode space, the membrane and the cathode space are arranged adjacent to each other in the stated order along the stacking direction, and wherein each of the layers further includes a respective electrically insulating shell that surrounds the anode space and the cathode space so as to enclose the anode space and the cathode space radially with respect to the stacking direction, wherein the shell includes a groove on at least one of its end faces in the stacking direction, wherein the groove surrounds the anode space and the cathode space at least partially.

14 Claims, 1 Drawing Sheet

(51) Int. Cl.
*C25B 11/032* (2021.01)
*C25B 15/08* (2006.01)

(56) References Cited

OTHER PUBLICATIONS

European Search Report and Written Opinion for corresponding EP 21207818, May 19, 2020.

* cited by examiner

ELECTROLYSIS STACK

CROSS REFERENCE TO RELATED APPLICATIONS

This application claims the benefit of priority under 35 U.S.C. § 119 (a) and (b) to European Patent Application No. 21207818.2, filed Nov. 11, 2021, the entire contents of which are incorporated herein by reference.

BACKGROUND

The invention is directed to an electrolysis stack and a method for performing water electrolysis using such an electrolysis stack.

On an industrial scale electrolysis is frequently performed using electrolysis stacks. Therein, high voltages and large currents may occur. Operators are protected therefrom in particular by delineating dangerous zones and by an electrically isolating housing provided around the electrolysis stack. Delineating dangerous zones is simple, but not sufficient. Providing an electrically isolating housing around the electrolysis stack is efficient. However, with a housing around the electrolysis stack it is impossible to visually inspect the electrolysis stack. Thus, leakages of the electrolysis stack cannot be detected easily. This is particularly an issue in case the electrolysis stack is operated at high pressure.

SUMMARY

The object of the invention is to provide an electrolysis stack that is safe to use and easy to inspect.

The object is solved with the electrolysis stack and method according to the independent claims. Advantageous refinements are presented in the dependent claims. The features described in the claims and in the description can be combined with each other in any technologically reasonable manner.

According to the invention an electrolysis stack is presented that comprises multiple layers that are stacked along a stacking direction, wherein each of the layers comprises an anode space with an anode, a cathode space with a cathode and a membrane that separates the anode space and the cathode space from each other, wherein the anode space, the membrane and the cathode space are arranged adjacent to each other in the stated order along the stacking direction, and wherein each of the layers further comprises a respective electrically isolating shell that surrounds the anode space and the cathode space so as to enclose the anode space and the cathode space radially with respect to the stacking direction, wherein the shell comprises a groove on at least one of its end faces in the stacking direction, and wherein the groove surrounds the anode space and the cathode space at least partially.

The electrolysis stack is preferably configured to perform water electrolysis. Thereby, hydrogen and oxygen can be produced from a medium that comprises water, However, the electrolysis stack can also be used for various other types of electrolysis, Preferably, the electrolysis stack is configured for performing electrolysis on an industrial scale. Preferably, the electrolysis stack has a power of at least 1 MW, in particular of at least 5 MW.

The electrolysis stack comprises multiple layers. Within each of the layers the electrolysis can be performed. That is, in the case of water electrolysis, hydrogen and oxygen can be produced separately with each of the layers.

Each of the layers comprises an anode space with an anode, a cathode space with a cathode and a membrane that separates the anode space and the cathode space from each other.

The anode space is configured such that the electrolyte can be filled into the anode space and come into contact with the anode within the anode space. The anode can be arranged anywhere within the anode space. The anode space can be empty except for the anode. The anode can also be configured in a porous manner or as a mesh. In particular in such a case it is possible that the anode is distributed across the anode space. In particular, the anode space with the anode can be configured as is known for AEMWE (anion exchange membrane water electrolysis) or PEM (polymer electrolyte membrane) electrolysis.

The cathode space is configured such that the electrolyte can be filled into the cathode space and come into contact with the cathode within the cathode space. The cathode can be arranged anywhere within the cathode space. The cathode space can be empty except for the cathode. The cathode can also be configured in a porous manner or as a mesh. In particular in such a case it is possible that the cathode is distributed across the cathode space. In particular, the cathode space with the cathode can be configured as is known for AEMWE (anion exchange membrane water electrolysis) or PEM (polymer electrolyte membrane) electrolysis.

The membrane separates the anode space and the cathode space from each other. The membrane is preferably configured as an anion exchange membrane. Moreover, the membrane can be configured for PEM (polymer electrolyte membrane) electrolysis.

The layers are stacked along a stacking direction. That is, the layers are arranged one after the other when viewed along the stacking direction. Neighboring layers are preferably in contact with each other. The layers are preferably arranged perpendicular to the stacking direction.

For each of the layers the respective anode space, membrane and cathode space are arranged adjacent to each other in the stated order along the stacking direction. That is, when viewed along the stacking direction the anode space is arranged first, the membrane second and the cathode space third. The membrane is preferably arranged perpendicular to the stacking direction.

Each of the layers further comprises a respective electrically isolating shell that surrounds the anode space and the cathode space in a circumferential manner around to the stacking direction.

Each of the layers has a respective shell. That is, the shells of the layers are distinct from each other. A housing that surrounds the entire electrolysis stack would not qualify as shells within the meaning of the described electrolysis stack, It would be insufficient to arbitrarily divide a housing into multiple shells. Instead, a physical distinction between the shells is required.

The shell surrounds the anode space and the cathode space of the respective layer. This means that the shell also surrounds the anode and cathode. Hence, the shells protect an operator from electrical voltages within the electrolysis stack. Further, the shells of neighboring layers preferably adjoin each other in a fluid tight manner, Since each of the layers has its own shell, the electrolysis stack can be inspected easily. A leakage can be visible since in such a case the electrolyte would not only leave the respective anode space and/or the respective cathode space but could also penetrate through the interface between neighboring shells. This way, a leakage can be easily detected. With a housing surrounding the entire stack this would not be possible.

The shell comprises a groove on at least one of its end faces in the stacking direction. That is, when viewed along the stacking direction, the shells extend between their respective end faces. The end faces are preferably arranged perpendicularly to the stacking direction. The respective groove surrounds the anode space and the cathode space at least partially. In case electrolyte leaks from an anode chamber and/or from a cathode chamber, the electrolyte can be collected by the groove arranged between the respective layers. The presence of electrolyte in the groove can be an indication of a leak, Electrolyte within a groove can be detected, for example, in that the groove terminates at a location where the electrolyte can be detected visually. With the groove described electrolysis stack is particularly easy to inspect because leakages can be detected particularly well.

The groove on the end face of the layer in the stacking direction that surrounds the anode space and the cathode space at least partially can have a semicircular cross section, a rectangular cross section or any other kind of a cross section.

In a preferred embodiment of the electrolysis stack the groove forms a respective first drainage path between adjacent layers. In other words, the groove on a top end face of a first layer is closed by a bottom end face of a second layer that is immediately adjacent to the first layer in the stacking direction. Thus, forming a first drainage path, wherein the second layer has no groove towards the first layer. It is also possible that adjacent layers have a respective groove at their interface so that two grooves together form a first drainage path between these layers. If a leakage between two adjacent layers occurs, the leaking fluid is collected in the first drainage path formed by the grooves, respectively by the first drainage path formed by a single groove. Furthermore, it is also possible that a layer has several grooves on at least one of its end faces in the stacking direction that at least partially surround the anode space and the cathode space. These grooves are preferably configured parallel to each other.

It is further preferred that the first layer in the stacking direction and the layer that is the last in the stacking direction comprise only one groove on their end faces towards the end face of a respective adjacent layer, each. In a preferred embodiment the layers between the first and the last layer in the stacking direction respectively comprise a groove on both end faces.

In order to keep the production of the layers as inexpensive as possible, it is advantageous if the layers are formed identically to each other, independent of their position in the stack.

In a further preferred embodiment of the electrolysis stack the first drainage paths are connected to each other by a second drainage path. The connection of the first drainage path and the second drainage path leads to the result that fluid leaking from the layers is collected in the first drainage paths and then drained collectively via the second drainage path.

In a further preferred embodiment of the electrolysis stack the second drainage path is formed within the shells. In order to make the production of a layer as simple as possible, the second drainage path is formed within the shell. Therefore, the second drainage path can be a bore that connects the respective first drainage paths of the layers in stocking direction.

In an alternative, however, the second drainage path is located outside of the shells.

In a further preferred embodiment of the electrolysis stack the second drainage path is inclined by less than 20° with respect to the stacking direction. In addition, the second drainage path does not necessarily have to run in a straight line, the second drainage path can also be arranged in sections over the layers between the adjacent layers at other positions of the first drainage paths. However, it is preferred that the second drainage path is oriented towards a lower level in order to facilitate the drainage of leaking fluid.

In a further preferred embodiment of the electrolysis stack a third drainage path is connected with its first end to one of the first drainage paths and/or to the second drainage path and forms with its second end an opening in the shell. With other words, the third drainage path is designed to drain fluid drained from the first drainage paths through the second drainage path out of the stack.

However, in an alternative fluid from the first drainage paths can be drained directly through the third drainage path out of the respective layer and thus also out of the stack. This has the advantage that an operator can immediately and clearly see from which particular layer fluid is leaking.

In any case, the drained fluid can be disposed of or returned to the electrolysis stack via the electrolyte supply conduit.

In a further preferred embodiment of the electrolysis stack the groove fully surrounds the anode space and the cathode space. This has the advantage that leaking fluid from the end faces of two adjacent layers is always drained by the grooves or the drainage paths formed by the grooves. Leaking fluid on the outside of the layer is thus excluded. Hence the fully surrounding grooves have the advantage that short circuits caused by leakages are avoided.

In a further preferred embodiment of the electrolysis stack the groove is shaped to contribute to a positive or frictional connection between adjacent layers. Thus, the grooves not only ensure the drainage of leaking fluid, but also improve the structural integrity of the electrolysis stack. This can be facilitated, for example, by a groove of a first layer having a shape complementary to a groove of an adjacent second layer. These complementary shapes can be formed in an interlocking manner. Alternatively, or additionally, horizontally adjacent flanks of the layer can have roughenings which are configured to increase the static friction between the layers.

In a further preferred embodiment of the electrolysis stack the first drainage paths have a diameter that increases towards the second drainage path. To increase the drainage of leaking fluid, it is advisable to make the grooves or the first drainage path slightly sloping towards the second drainage path. This can be achieved by a slightly conical shape of the groove. However, a continuously deepening groove is also probable.

In an alternative, the first drainage paths have a constant diameter. Hence, in the event of a leakage the following fluid pushes itself out of the drainage paths.

In a further preferred embodiment, the electrolysis stack further comprises a first electrode connected to the anode of the layer that is the first in the stacking direction, wherein the first electrode passes through the shell of this layer, and/or further comprising a second electrode connected to the cathode of the layer that is the last in the stacking direction, wherein the second electrode passes through the shell of this layer. The "and" case is preferred. The described electrolysis stack is configured in such a way that the electrical connection to the layers first and last in the stacking direction of the stack is sufficient to supply all layers of the electrolysis stack, or all anodes and cathodes, with an adequate and constant current and voltage.

The resulting advantage is that a possible short circuit caused by leaking fluid is given as little surface area as possible. In addition, the risk for an operator is significantly reduced since the number of electrical connections to the stack are reduced to a minimum. In addition, further breaches caused by other connections are avoided. Consequently, the possibility of leaking is significantly reduced, since a corresponding weak spot, like the breach, is reduced to a minimum.

In a further preferred embodiment of the electrolysis stack for at least one of the layers the respective anode space comprises a gas diffusion region that is arranged between the membrane and the anode of the respective layer, and/or wherein for at least one of the layers the cathode space comprises a gas diffusion region that is arranged between the membrane and the cathode of the respective layer. The "and" case is preferred. With other words, the gas diffusion region of the anode space is designed to remove the oxygen generated during electrolysis. In addition, the gas diffusion region of the cathode space is designed to remove the hydrogen produced simultaneously to the oxygen during electrolysis.

In view of operation safety of the electrolysis stack, the generated oxygen and hydrogen gases are removed from the electrolysis stack in operation. Thereby, the efficiency of the electrolysis stack can be kept at the highest possible level and, at the same time, a potential risk of explosion can be reduced. In particular, to avoid the risk of an explosion, the gas diffusion regions of oxygen and hydrogen are preferably separated from each other in a gas-tight manner. A separation of the gas diffusion regions from each other is preferable, since pure oxygen and pure hydrogen are to be produced by the electrolysis stack. Mixing the gases is not desirable neither for economic reasons nor for safety reasons.

In a further preferred embodiment of the electrolysis stack at least one of the anodes forms a bipolar plate together with the cathode of one of the neighboring layers. To reduce the layer thickness and thus increase efficiency per volume, the respective anodes form a bipolar plate together with the respective cathode of one of the neighboring layers.

In a further preferred embodiment of the electrolysis stack an electrolyte supply conduit and/or an electrolyte drain conduit passes through the shell of at least one of the layers. The "and" case is preferred. In order to keep the electrolyte level in the layers constant and thus ensure a uniform output of oxygen and hydrogen, the electrolysis stack is preferably continuously supplied with fresh electrolyte by the electrolyte supply conduit. On the output side of the electrolysis stack the electrolyte is drained via the electrolyte drain conduit.

It is possible for the anode spaces to be supplied with electrolyte independently of the cathode spaces. It is preferred that the respective electrolyte flow from the anode spaces and cathode spaces transports the generated gas out of the layer and the electrolysis stack. However, it is also possible that the electrolyte supply conduit supplies electrolyte jointly to both the anode spaces and the cathode spaces.

In a further preferred embodiment of the electrolysis stack for at least one of the layers the respective membrane is an anion exchange membrane. An anion exchange membrane (AEM) is a semipermeable membrane generally made from ionomers and designed to conduct anions while being impermeable to gases such as oxygen or hydrogen. Anion exchange membranes are used in electrolytic cells and fuel cells to separate reactants present around the two electrodes while transporting the anions essential for the cell operation.

As a further aspect of the invention a method is presented for performing water electrolysis using an electrolysis stack configured as described, wherein for each of the layers a respective electrical voltage is applied between the anode and the cathode.

The advantages and features of the described electrolysis stack are transferrable to the described method, and vice versa. The described electrolysis stack is preferably configured to be used according to the described method.

In a preferred embodiment of the method the electrolysis is an anion exchange membrane water electrolysis, AEMWE. Anion exchange membrane water electrolyzes (AEMWEs) are considered one of the most promising sustainable hydrogen production technologies because of their ability to split water using platinum group metal-free catalysts, less expensive anode flow fields, and bipolar plates.

In a further preferred embodiment of the method for at least one of the layers a pressure within the anode space is greater than 5 bar and/or a pressure within the cathode space is greater than 5 bar. The "and" case is preferred. It is generally known that with an increased pressure ratio of the reactant, in the case of water electrolysis the water, the efficiency of the electrolysis device increases. In particular, this effect can be increased by further increasing the pressures.

BRIEF DESCRIPTION OF THE DRAWINGS

In the following the invention will be described with respect to the figures. The figures show a preferred embodiment, to which the invention is not limited. The figures and the dimensions shown therein are only schematic. The figures show.

DETAILED DESCRIPTION OF PREFERRED EMBODIMENTS

Figure 1:
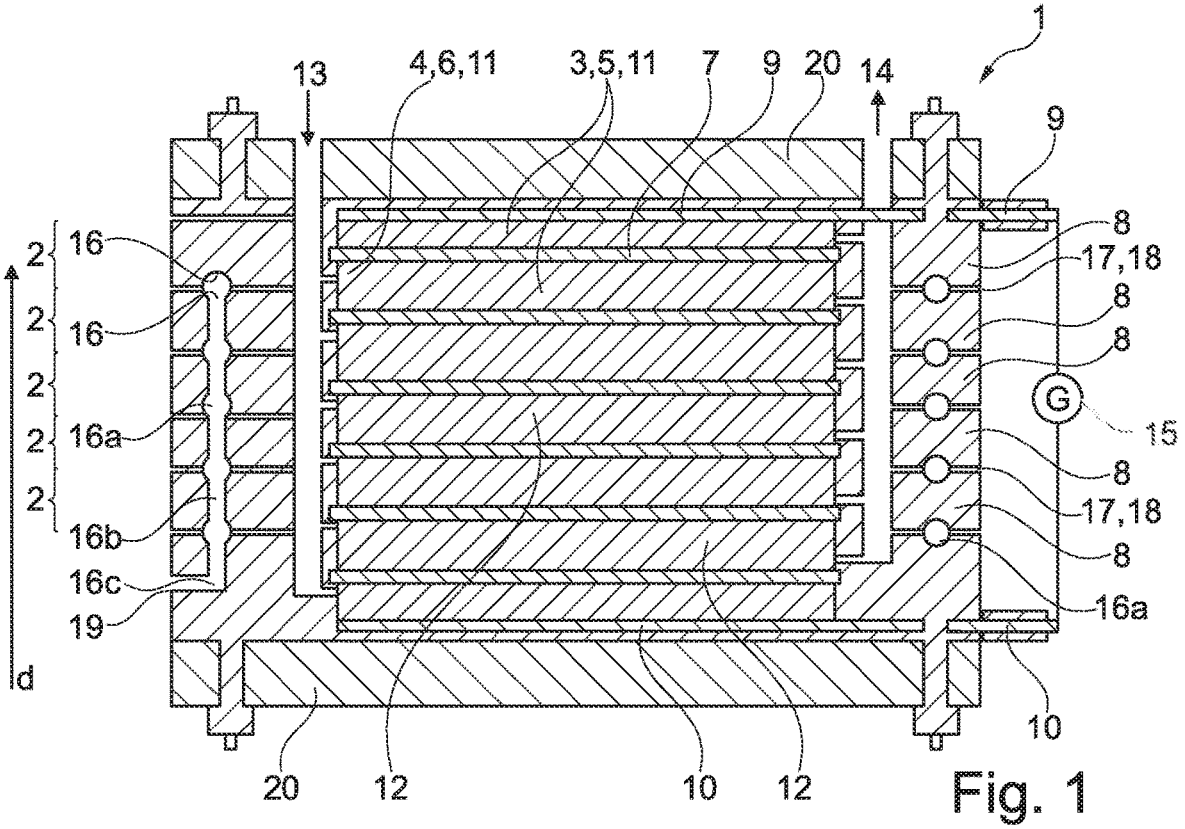
FIG. 1 illustrates a sectional side view of the device according to the invention.

FIG. 1 shows an electrolysis stack 1, comprising multiple layers 2 that are stacked along a stacking direction d. The layers 2 each comprise an anode space 3 with an anode 5, a cathode space 4 with a cathode 6 and a membrane 7 that separates the anode space 3 and the cathode space 4 from each other and that is an anion exchange membrane 7. To perform the electrolysis, for each of the layers 2 a respective electrical voltage is applied between the anode 5 and the cathode 6, wherein in this case the electrolysis is an anion exchange membrane water electrolysis, AEMWE.

The anode space 3, the membrane 7 and the cathode space 4 are arranged adjacent to each other in the stated order along the stacking direction d and are held in this order by a pair of clamping plates 20. One of the clamping plates 20 is located above the first layer 2 in the stacking direction d, while the bottom clamping plate 20 is located below the last layer 2 in the stacking direction d. The clamping plates 20 are connected to each other by threaded bolts, not shown in the figures.

Further, each of the layers 2 comprises a respective electrically insulating shell 8 that surrounds the anode space 3 and the cathode space 4 so as to enclose the anode space 3 and the cathode space 4 radially with respect to the stacking direction d. Furthermore, the shells 8 comprise a respective groove 16 on at least one of their end faces 17, 18 in the stacking direction d, wherein the grooves 16 each surround the respective anode space 3 and cathode space 4 at least partially.

The grooves 16 are shaped to form a respective first drainage path 16*a* between adjacent layers 2. If fluid leaks from the layers 2, the fluid can be drained via the first drainage paths 16*a*. In other words, the groove 16 of a first layer 2 is closed by a second layer 2 that is immediately adjacent to the first layer 2 in the stacking direction d, thus forming a first drainage path 16*a*. As shown in FIG. 1, both layers 2 have a groove 16 in their end faces 17, 18 towards each other, so that both groves 16, adjacent to each other form the first drainage path 16*a* between the adjacent layers 2. If a leakage between two adjacent layers 2 occurs, the leaking fluid is collected in the first drainage path 16*a* formed by the opposing grooves 16.

The first layer 2 in the stacking direction d and the layer 2 that is the last in the stacking direction d have a groove 16 only on one of their end faces 17, 18 . The layers 2 between the first and the last layer 2 in the stacking direction d respectively comprise a groove 16 on both their end faces 17, 18.

To remove leaking fluid from the layers 2, the first drainage paths 16*a* are connected to each other by a second drainage path 16*b*. Further, a third drainage path 16*c* is connected with its first end to the second drainage path 16*b* and forms with its second end an opening 19 in the shell 8. Thus, fluid leaking from the anode spaces 3 and cathode spaces 4 can be led out of the electrolysis stack 1 via the first, second and third drainage paths 16*a*, 16*b*, 16*c*.

Even if not shown in the figures, to improve the drainage of the liquid, the drainage paths 16*a*, 16*b*, 16*c* can have a diameter that increases towards the opening 19. With other words, the diameter of the first drainage path 16*a* can increases towards the intersection area of the first drainage path 16*a* with the vertically running second drainage path 16*b*. The second and third drainage paths 16*b*, 16*c* can also have a diameter that increases towards the opening 19.

To provide the electrolysis stack 1 with electrical energy, a first electrode 9 is connected to the anode 5 of the layer 2 that is the first in the stacking direction d, wherein the first electrode 9 passes through the shell 8 of this layer 2. A second electrode 10 is connected to the cathode 6 of the layer 2 that is the last in the stacking direction d, wherein the second electrode 10 passes through the shell 8 of this layer 2. The first electrode 9 and the second electrode 10 are connected to a voltage source 15.

The anode spaces 3 comprise a respective gas diffusion region 11 that is arranged between the membrane 7 and the anode 5 of the respective layer 2, wherein the cathode spaces 4 comprise a respective gas diffusion region 11 that is arranged between the membrane 7 and the cathode 6 of the respective layer 2. With other words, the gas diffusion regions 11 of the anode spaces 3 are designed to remove the oxygen generated during electrolysis. In addition, the gas diffusion regions 11 of the cathode spaces 4 are designed to remove the hydrogen produced simultaneously. To continuously supply the layers 2 with the appropriate electrolyte, an electrolyte supply conduit 13 and an electrolyte drain conduit 14 passes through the shell 8 of each layer 2.

To reduce the layer 2 thickness and thus increase the efficiency per volume, the anodes 5 form a respective bipolar plate 12 together with the cathode 6 of one of the neighboring layers 2.

Figure 2:
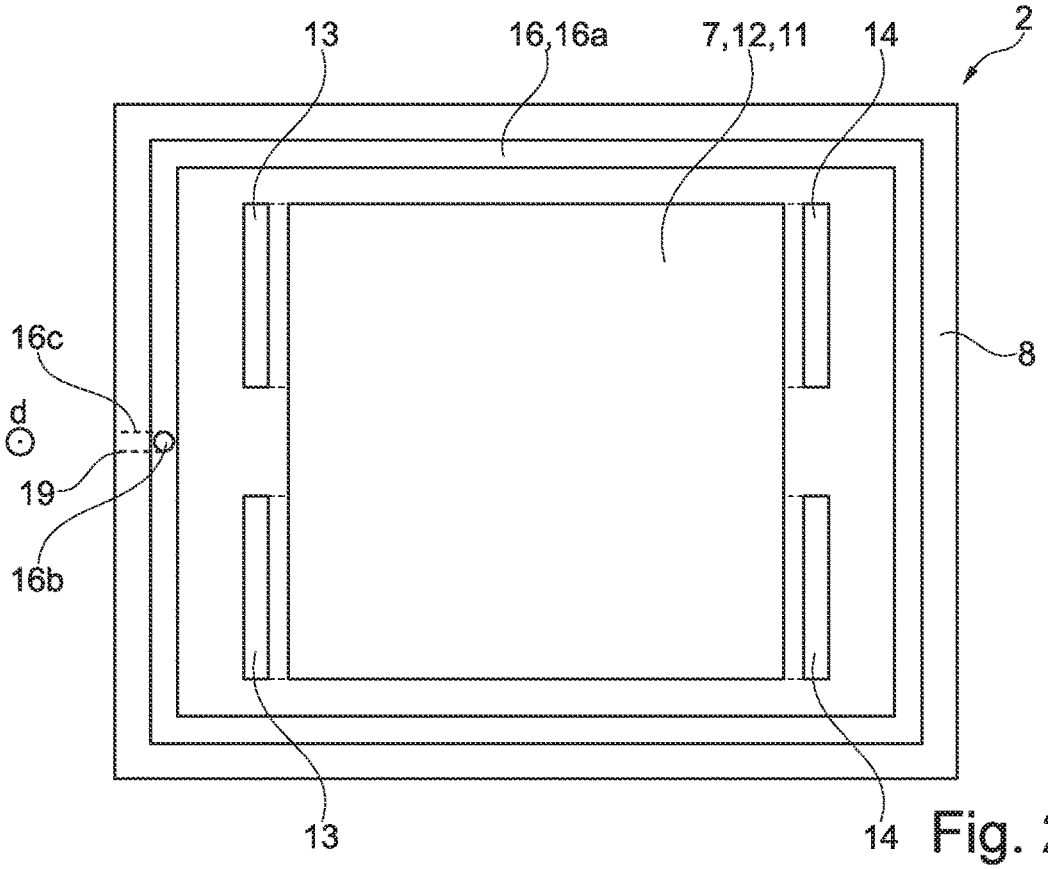
FIG. 2 illustrates a sectional plan view of the device according to the invention.

FIG. 2 shows a top view of one of the layers 2. It can be seen that the groove 16 fully surrounds the anode space 3 and the cathode space 4. To better arrange the layers 2 in the stacking direction d, the groove 16 is shaped to contribute to a positive or frictional connection between adjacent layers 2. Thus, the grooves 16 also improve the structural integrity of the electrolysis stack 1. This can be enhanced, for example, by a groove 16 of a first layer 2 having a shape complementary to that of the adjacent second layer 2 or complementary to a groove 16 of the second layer 2. These complementary shapes can be realized, for example, in an interlocking manner.

LIST OF REFERENCE NUMERALS

1 electrolysis stack
2 layer
3 anode space
4 cathode space
5 anode
6 cathode
7 membrane
8 shell
9 first electrode
10 second electrode
11 gas diffusion region
12 bipolar plate
13 electrolyte supply conduit
14 electrolyte drain conduit
15 voltage source
16 groove
16*a* first drainage path
16*b* second drainage path
16*c* third drainage path
17 end face
18 end face
19 opening
20 clamping plates
d stacking direction

What is claimed is:

1. An electrolysis stack, comprising multiple layers that are stacked along a stacking direction, wherein each of the layers comprises an anode space with an anode, a cathode space with a cathode and a membrane that separates the anode space and the cathode space from each other, wherein the anode space, the membrane and the cathode space are arranged adjacent to each other in the stated order along the stacking direction, and wherein each of the layers further comprises a respective electrically insulating shell that surrounds the anode space and the cathode space so as to enclose the anode space and the cathode space radially with respect to the stacking direction, wherein the shell comprises a groove on at least one of its end faces in the stacking direction, wherein the groove surrounds the anode space and the cathode space at least partially, and wherein the groove forms a respective first drainage path between adjacent layers.

2. The electrolysis stack according to claim 1, wherein the first drainage paths are connected to each other by a second drainage path.

3. The electrolysis stack according to claim 2, wherein the second drainage path is formed within the shells.

4. The electrolysis stack according to claim 2, wherein the second drainage path is inclined by less than 20° with respect to the stacking direction.

5. The electrolysis stack according to claim 1, wherein a third drainage path is connected with its first end to one of the first drainage paths and/or to the second drainage path and forms with its second end an opening in the shell.

6. The electrolysis stack according to claim 1, wherein the groove fully surrounds the anode space and the cathode space.

7. The electrolysis stack according to claim 1, wherein the groove is shaped to contribute to a frictional connection between adjacent layers.

8. The electrolysis stack according to claim 3, wherein the first drainage paths have a diameter that increases towards the second drainage path.

9. The electrolysis stack according to claim 1, further comprising a first electrode connected to the anode of the layer that is the first in the stacking direction, wherein the first electrode passes through the shell of this layer, and/or further comprising a second electrode connected to the cathode of the layer that is the last in the stacking direction, wherein the second electrode passes through the shell of this layer.

10. The electrolysis stack according to claim 1, wherein for at least one of the layers the respective anode space comprises a gas diffusion region that is arranged between the membrane and the anode of the respective layer), and/or wherein for at least one of the layers the cathode space comprises a gas diffusion region that is arranged between the membrane and the cathode of the respective layer.

11. The electrolysis stack according to claim 1, wherein at least one of the anodes forms a bipolar plate together with the cathode of one of the neighboring layers.

12. The electrolysis stack according to claim 1, wherein an electrolyte supply conduit and/or an electrolyte drain conduit passes through the shell of at least one of the layers.

13. The electrolysis stack according to claim 1, wherein for at least one of the layers the respective membrane is an anion exchange membrane.

14. A method for performing water electrolysis using an electrolysis stack according to claim 1, wherein for each of the layers a respective electrical voltage is applied between the anode and the cathode.

* * * * *